US006063257A

United States Patent [19]

Kimura et al.

[11] Patent Number: 6,063,257

[45] Date of Patent: May 16, 2000

[54] BIPOLAR TYPE ION EXCHANGE MEMBRANE ELECTROLYTIC CELL

[75] Inventors: Tatsuhito Kimura; Mikio Suzuki; Tatsushi Ozawa, all of Ichihara, Japan

[73] Assignee: Asahi Glass Company, Ltd., Tokyo, Japan

[21] Appl. No.: 09/161,480

[22] Filed: Sep. 28, 1998

[30] Foreign Application Priority Data

Sep. 30, 1997 [JP] Japan ..... 9-28109

[51] Int. Cl.[7] ..... C25B 9/04; C25B 13/02

[52] U.S. Cl. ..... 205/511; 205/526; 204/254; 204/255

[58] Field of Search ..... 204/254, 255; 205/511, 526

[56] References Cited

U.S. PATENT DOCUMENTS

| | | | |
|---|---|---|---|
| 4,581,114 | 4/1986 | Morris et al. | 204/254 |
| 4,789,443 | 12/1988 | DeNora et al. | 204/254 |
| 5,571,390 | 11/1996 | Kimura et al. . | |

FOREIGN PATENT DOCUMENTS

| | | |
|---|---|---|
| 0 111 149 | 6/1984 | European Pat. Off. . |
| 0 412 600 | 2/1991 | European Pat. Off. . |
| WO 86/05216 | 9/1986 | WIPO . |

*Primary Examiner*—Arun S. Phasge
*Attorney, Agent, or Firm*—Oblon, Spivak, McClelland, Maier & Neustadt, P.C.

[57] ABSTRACT

A bipolar type ion exchange membrane electrolytic cell comprising an anode compartment frame which comprises an anode plate and an anode back plate arranged in substantially parallel with each other with a spacing, and a conductive anode supporting member arranged between the anode plate and the anode back plate, and a cathode compartment frame which comprises a cathode plate and a cathode back plate arranged in substantially parallel with each other with a spacing, and a conductive cathode supporting member arranged between the cathode plate and the cathode back plate, so that the anode back plate and the cathode back plate are connected back to back to form a partition wall for a bipolar electrolytic cell, wherein (a) the spacing between the anode plate and the anode back plate is wider than the spacing between the cathode plate and the cathode back plate, (b) the anode supporting member and/or the cathode supporting member, is arranged in plurality, and (c) between the adjacent anode and/or cathode supporting members, an anode and/or cathode partition sheet is inserted in substantially parallel with the anode and/or cathode plate to form two spaces which extend in a vertical direction respectively between the anode and/or cathode partition sheet and the anode and/or cathode plate and between the anode and/or cathode partition sheet and the anode and/or cathode back plate, so that the two spaces are connected to each other at their upper and lower portions to form an internal circulation path for an electrolyte.

4 Claims, 4 Drawing Sheets

BIPOLAR TYPE ION EXCHANGE MEMBRANE ELECTROLYTIC CELL

The present invention relates to a bipolar type ion exchange membrane electrolytic cell which is capable of maintaining the distribution of electrolyte concentration uniformly in the electrolytic cell even at a high current density.

Ion exchange membrane electrolytic cells which have been widely used, are of a filter press type electrolytic cell wherein a number of ion exchange membranes and compartment frame units each comprising an anode compartment frame and a cathode compartment frame, are alternately arranged and clamped from both sides by e.g. a hydraulic press. The electrolytic cell of this type is generally classified into a monopolar type electrolytic cell (monopolar cell) of a parallel connection type and a bipolar type electrolytic cell (bipolar cell) of a serial connection type, which are distinguishable by the difference in electrical connection.

As shown in FIGS. 1 and 2, in a compartment frame unit (an anode compartment frame+a cathode compartment frame) for a bipolar cell, an anode compartment 15 and a cathode compartment 25 are arranged back to back, and an anode compartment frame 10 constituting the anode compartment 15, comprises an anode plate 30 and an anode back plate 40 arranged in substantially parallel with the anode plate with a spacing therefrom. As such an anode plate, it is common to employ a meshed or porous plate. For example, a conductive meshed plate of e.g. titanium, zirconium or tantalum is used as a substrate, and an oxide of a noble metal such as titanium oxide, ruthenium oxide or iridium oxide, is coated thereon.

Between the anode plate 30 and the anode back plate 40, a corrosion resistant conductive anode supporting member (rib) 50*a* made of e.g. titanium or a titanium alloy, is arranged to electrically connect the two and to maintain the spacing therebetween. The anode supporting member 50*a* may, for example, be made of a plate member and provided with a plurality of through-holes (not shown) so that an electrolyte can flow in the left and right directions in FIGS. 1 and 2.

The construction of the cathode compartment frame 20 for providing a cathode compartment 25 is the same as that of the anode compartment frame 10. Namely, it comprises-a meshed or porous cathode plate 60, a cathode back plate 70 and a cathode supporting member 80*a*.

Namely, between the cathode plate 60 and the cathode back plate 70, a corrosion resistant conductive cathode supporting member 80*a* made of e.g. iron, nickel or a nickel alloy, is arranged to electrically connect the two and to maintain the spacing therebetween. The anode back plate 40 and the cathode back plate 70 are integrally connected to form a partition wall 9. Between the anode back plate 40 and the cathode back plate 70 constituting the partition wall 9, a conductive interlayer member such as a cladding material (not shown) may be inserted in order to increase the electrical conductivity. A peripheral edge portion of each of the anode back plate 40 and the cathode back plate 70 constituting the partition wall, is bent and fixed to a hollow body 7 by e.g. welding. Reference numeral 11 indicates an ion exchange membrane, and numeral 12 a gasket. The cathode plate is preferably made of an alkali resistant material, such as a substrate made of e.g. a conductive meshed plate of e.g. nickel or stainless steel, coated with a cathode active material such as Raney nickel.

In a case where such a bipolar cell is used for electrolysis of an alkali metal halide such as sodium chloride, an almost saturated sodium chloride aqueous solution is supplied as an anolyte to a anode compartment from an anolyte inlet 3 which is usually provided at a lower portion of the anode compartment. In the anode compartment, chlorine gas is generated on the anode plate by electrolysis, and it will be discharged, together with the aqueous sodium chloride solution as the electrolyte, out of the anode compartment frame from an anolyte outlet 4 which is provided usually at an upper portion of the anode compartment.

On the other hand, in a cathode compartment, water or a dilute sodium hydroxide aqueous solution is supplied as a catholyte to the cathode compartment from a catholyte inlet 5 which is provided usually at a lower portion of the cathode compartment. In the cathode compartment, hydrogen gas and sodium hydroxide are formed and discharged out of the cathode compartment from a catholyte outlet 6 which is provided at an upper portion of the cathode compartment.

The role of an ion (cation) exchange membrane used for this sodium chloride electrolysis, is to let sodium ions pass from the anode compartment side to the cathode compartment side and to shut off movement of hydroxyl ions generated on the cathode side to the anode compartment side. The higher the shut-off performance against movement of hydroxyl ions is, the higher is the current efficiency of the ion exchange membrane.

The performance of the ion exchange membrane is substantially influenced by (1) the sodium chloride concentration in the anode compartment and (2) the sodium hydroxide concentration in the cathode compartment, and there are the optimum concentrations. Accordingly, the sodium chloride concentration in the anode compartment and the sodium hydroxide concentration in the cathode compartment are preferably maintained at the respective optimum concentrations to maximize the performance of the ion exchange membrane, uniformly throughout the entire compartment frame unit.

However, in a practical operation, as the electrolyte rises from the lower portion to the upper portion in the compartment, on the anode side, sodium chloride is consumed, and its concentration becomes thin. On the other hand, on the cathode side, sodium hydroxide is formed, whereby the concentration of sodium hydroxide tends to be high at the upper portion of the cathode compartment.

At present, in order to accomplish high productivity, it is desired to carry out the operation at a high electrolytic current density of a level of from 5 to 6 $kA/m^2$. However, the higher the electrolytic current density is, the higher is the speed for movement of substance. Accordingly, it is likely that the concentration gradient of sodium chloride between the lower portion and the upper portion on the anode side, and the concentration gradient of sodium hydroxide between the lower portion and the upper portion on the cathode side, tend to be large. If the concentration gradients become large in this manner, it is eventually likely that the concentrations depart from the proper operational concentrations for the ion exchange membrane, whereby the performance of the ion exchange membrane substantially decreases.

With the conventional structure of an electrolytic cell (e.g. JP-B-6-74513), there is no substantial circulating flow of an electrolyte in an up or down direction in the compartment frame unit, and as the electrolytic current density is increased, the concentration gradients of the electrolytes in a vertical direction become large, as mentioned above, and eventually lead to a situation where the operation will no longer be practically possible.

To solve such a problem, in order to promote internal circulation in the compartment frame unit, Japanese Patent 2581685 and JP-A-58-217684 propose to form a space between a back plate and a conductive rib having a trapezoid or triangle shape in its cross section, so that this space is used as a down-flowing internal circulation path, or JP-A-4-289186 proposes to provide a cylindrical internal circulation duct in a vertical direction in a compartment frame, so that the circulation duct serves as an internal circulation path. However, by a study by the present inventors, it has been found that such constructions are still inadequate and can not substantially diminish the concentration gradients, at such a high electrolytic current density as intended by the present invention, although an internal circulation flow may certainly be formed.

It is an object of the present invention to provide an electrolytic cell which is capable of maintaining the performance of the ion exchange membrane at a high level over a long period of time by maintaining the electrolyte concentrations in the anode compartment and/or the cathode compartment uniformly over the entire electrolysis surface by promoting the internal circulation of the electrolytes, even for an operation at a high electrolytic current density.

More specifically, it is an object of the present invention to provide a bipolar cell which can be operated under a stabilized condition even at a high electrolytic current density of a level of at least 5 $kA/m^2$ or even at 8 $kA/m^2$, whereby a high current efficiency and a low cell voltage can be accomplished.

The present invention provides:

A bipolar type ion exchange membrane electrolytic cell comprising an anode compartment frame which comprises an anode plate and an anode back plate arranged in substantially parallel with each other with a spacing, and a conductive anode supporting member arranged between the anode plate and the anode back plate, and a cathode compartment frame which comprises a cathode plate and a cathode back plate arranged in substantially parallel with each other with a spacing, and a conductive cathode supporting member arranged between the cathode plate and the cathode back plate, so that the anode back plate and the cathode back plate are connected back to back to form a partition wall for a bipolar electrolytic cell, wherein (a) the spacing between the anode plate and the anode back plate is wider than the spacing between the cathode plate and the cathode back plate, (b) each of the anode supporting member and/or the cathode supporting member, is arranged in plurality, and (c) between the adjacent anode supporting members, an anode partition sheet is inserted in substantially parallel with the anode plate to form two spaces which extend in a vertical direction respectively between the anode partition sheet and the anode plate and between the anode partition sheet and the anode back plate, so that the two spaces are connected to each other at their upper and lower portions to form an internal circulation path for an electrolyte, and/or between the adjacent cathode supporting members, a cathode partition sheet is inserted in substantially parallel with the cathode plate to form two spaces which extend in a vertical direction respectively between the cathode partition sheet and the cathode plate and between the cathode partition sheet and the cathode back plate, so that the two spaces are connected to each other at their upper and lower portions to form an internal circulation path for an electrolyte.

Now, the present invention will be described in detail with reference to the accompanying drawings in which.

Figure 2:
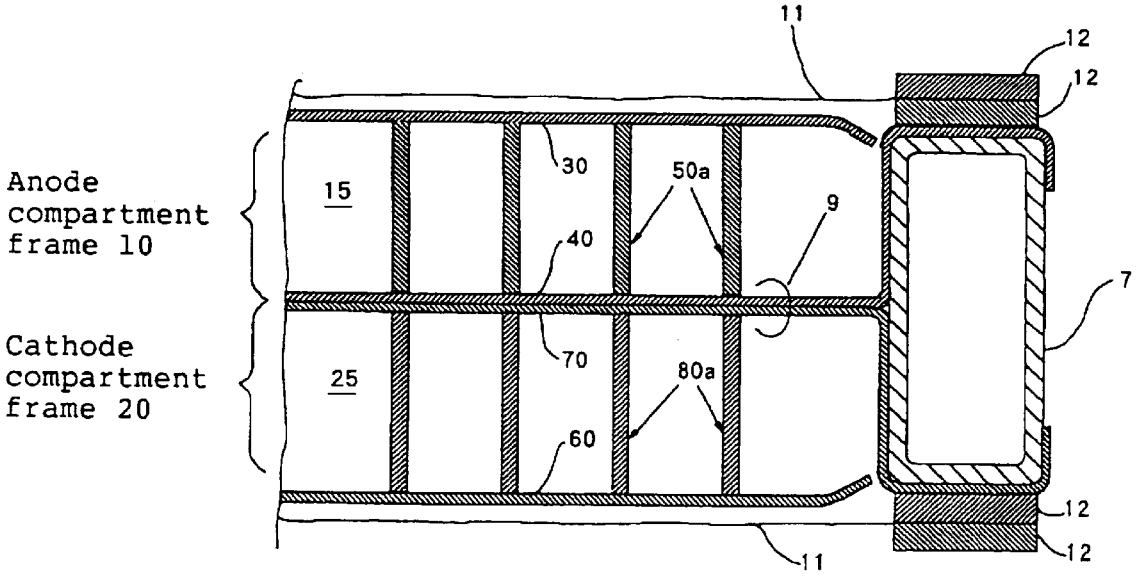
FIG. 2 PRIOR ART
FIG. 2 is a view showing the cross section taken along line A—A together with an ion exchange membrane and a gasket.
Figure 3:
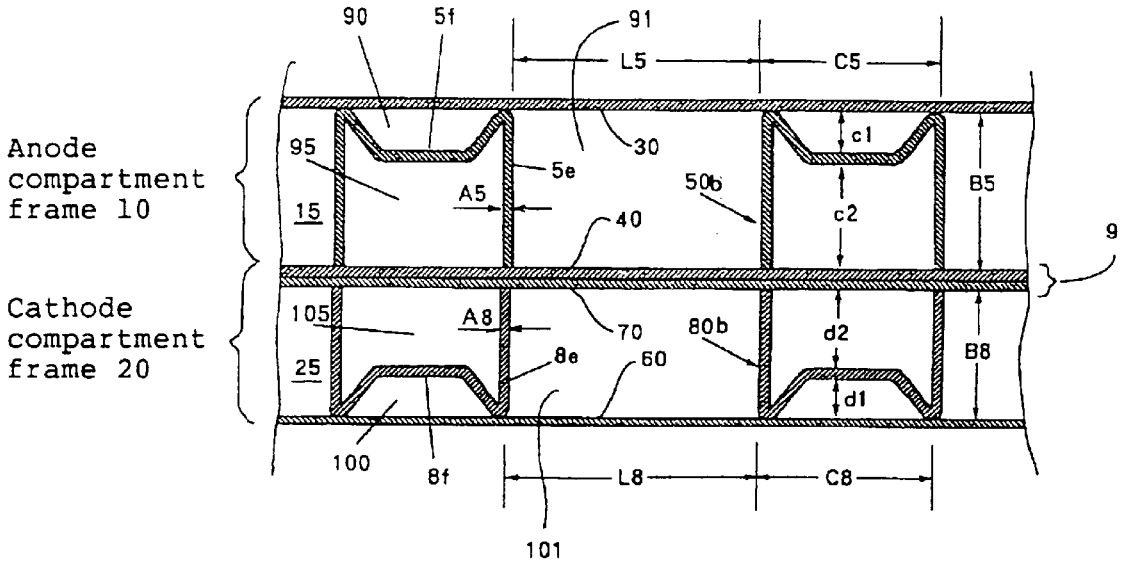
FIG. 3 is a partially cross-sectional view of a bipolar cell.

FIG. 3 illustrates a preferred embodiment of the present invention. This is basically the same as shown in FIG. 2 and is a bipolar cell comprising an anode compartment frame 10 which comprises an anode plate 30 and an anode back plate 40 arranged in substantially parallel with each other with a spacing, and a conductive anode supporting member 50*b* arranged between the anode plate 30 and the anode back plate 40, and a cathode compartment frame 20 which comprises a cathode plate 60 and a cathode back plate 70 arranged in substantially parallel with each other with a spacing, and a conductive cathode supporting member 80*b* arranged between the cathode plate 60 and the cathode back plate 70, so that the anode back plate 40 and the cathode back plate 70 are connected back to back to form a partition wall 9 for a bipolar electrolytic cell, but it is characterized in that the spacing B5 between the anode plate 30 and the anode back plate 40, is wider than the spacing B8 between the cathode plate 60 and the cathode back plate 70.

The supporting member (rib) 50*b* or 80*b* is arranged in plurality.

The shape of the anode supporting member or the cathode supporting member is not particularly limited and may be a plate shape (50*a*, 80*a*) as shown in FIG. 2. However, a more preferred shape is a substantially M shape in cross section (50*b*, 80*b*) as shown in FIG. 3.

Firstly, the anode supporting member 50*b* will be described. The anode supporting member is elongated and, like the cathode supporting member (80*a*) shown in FIG. 1, extends from the lower side portion 1 of the anode compartment frame to the upper side portion 2 of the anode compartment frame. Preferably, the supporting ember 50*b* has a substantially M shape in its cross section and comprises side wall portions 5*e* extending in a perpendicular direction from the anode back plate 40 to the anode plate 30 and an anode plate-facing portion 5*f* recessed to form a space between it and the anode plate 30, in which gas bubbles and the electrolyte ascend. The distance from 5*f* to the anode plate is represented by c1, and the distance from 5*f* to the anode back plate is represented by c2. Further, a space 95 within the anode supporting member, as defined by the anode back plate 40, the two side walls Se and the anode plate-facing portion 5*f*, constitutes a space in which the electrolyte descends. At upper end portions of the side walls 5*e* and the anode plate-facing portion 5*f*, through-holes or notches are formed, so that part of the electrolyte which has ascended in the spaces 90 and 91, will flow into the space 95 within the anode supporting member. Further, at lower end portions of the side walls 5*e* and the anode plate-facing portion 5*f*, through-holes or notches are formed, so that they serve as openings through which the electrolyte which has descended in the space 95, will be discharged again into the spaces 90 and 91. Thus, the space 95 formed between the anode supporting member 50*b* and the anode back plate 40, is connected-at its upper and lower portions to the spaces 90 and 91 to form an internal circulation path for an anolyte.

The anode supporting member may be made of the same conductive material as the anode such as titanium or a titanium alloy, and it is integrally formed by roll forming and fixed to the anode back plate and the anode plate by e.g. spot welding. Further, to secure the mechanical rigidity of the compartment frame, the anode supporting member 50*b* is welded to the upper side portion 2 and the lower side portion 1 of the anode compartment frame.

The transverse width (C5 in FIG. 3) of the anode supporting member is from 30 to 100 mm, preferably from 50 to 70 mm. While the longitudinal width B5 (which corresponds to the spacing between the anode plate 30 and the anode back plate 40) of the anode supporting member is from 30 to 40 mm, preferably from 32 to 38 mm, and is designed to be wider than the longitudinal width B8 (which corresponds to the spacing between the cathode plate 60 and the cathode back plate 70) of the cathode supporting member. The difference in the longitudinal widths (B5–B8) is from 2 to 10 mm, preferably from 4 to 7 mm. The reason for providing such a difference is as follows.

Namely, in a bipolar cell having a plurality of compartment frame units arranged, wherein each compartment frame unit comprises an anode compartment frame which comprises an anode plate and an anode back plate arranged in substantially parallel with each other with a spacing, and a conductive anode supporting member arranged between the anode plate and the anode back plate, and a cathode compartment frame which comprises a cathode plate and a cathode back plate arranged in substantially parallel with each other with a spacing, and a conductive cathode supporting member arranged between the cathode plate and the cathode back plate, so that the anode back plate and the cathode back plate are connected back to back to form a partition wall for a bipolar electrolytic cell, the electrolytes flowing in the compartments are likely to be heated to 90° C. or higher, if the electrolytic cell is operated at a high current density. On the other hand, the materials of parts constituting the anode compartment frame and the cathode compartment frame are usually different. Accordingly, due to the differences in the thermal expansion coefficient and the elastic modulus between the parts, the compartment frame unit comprising the anode compartment frame and the cathode compartment frame tends to deflect, and the compartment unit tends to bulge towards the cathode side to form a bow-shape. If this deflection of the compartment unit is large, the ion exchange membrane will be intensely pinched between the opposing anode and cathode plates and is likely to break, and in an extreme case, the operation of the electrolytic cell will have to be stopped.

In order to prevent such a trouble, it is conceivable to increase the distance between the anode plate and the cathode plate which are opposed with the ion exchange membrane interposed therebetween. However, such an attempt will bring about an increase of the cell voltage, such being undesirable. Whereas, in the present invention, the longitudinal width B5 of the anode supporting member is made to be wider than the longitudinal width B8 of the cathode supporting member, so that the eccentric moment and the unbalance moment due to bimetal efficiency work to cancel out each other, thereby to suppress the degree of deflection.

With the construction as described above, it will be possible to further shorten the distance between the anode plate and the cathode plate and to obtain a bipolar cell having a low cell voltage.

Further, in the present invention, the distance L5 between the adjacent anode supporting members is from 50 to 200 mm, preferably from 100 to 150 mm. With this distance, a plurality of anode supporting members 50*b* are arranged in parallel with one another to cover the electrolysis area, like cathode supporting members 80*a* shown in FIG. 1.

On the other hand, a cathode supporting member (rib) 80*b* is also elongated like the anode supporting member and extends from the lower side portion 1 of the cathode compartment frame to the upper side portion 2 of the cathode compartment frame. Preferably, the supporting member 80*b* has a substantially M-shape in its cross section and comprises side wall portions 8*e* extending in a perpendicular direction from the cathode back plate to the cathode plate, and a cathode plate-facing portion 8*f* recessed to form a space 100 between it and the cathode plate, so that a gas and an electrolyte ascend in the space. The distance between 8*f* and the cathode plate is represented by d1, and the distance between 8*f* and the cathode back plate is represented by d2. Further, a space 105 defined by the cathode back plate, the two side walls 8*e* and the cathode plate-facing portion 8*f*, constitutes a space in which the electrolyte descends. At upper end portions of the side walls 8*e* and the cathode plate-facing portion 8*f*, through-holes or notches are formed, so that part of the electrolyte which has ascended together with gas bubbles in the space 100, will flow into the space 105 within the cathode-supporting member. Further, at lower end portions of the side walls 8*e* and the cathode plate-facing portion 8*f*, through-holes or notches are formed, and they work as openings through which the electrolyte which has descended in the space 105, will be discharged again into the spaces 100 and 101. Thus, the space 105 formed between the cathode supporting member 80*b* and the cathode back plate, is connected at its upper and lower portions to the spaces 100 and 101 to form an internal circulation path for the catholyte.

The cathode supporting member may be made of the same conductive material as the cathode, such as nickel or a nickel alloy (including a stainless steel material), and it is integrally formed by e.g. roll forming and fixed to the cathode back plate and the cathode plate by e.g. spot welding. Further, to secure the mechanical rigidity of the compartment frame, the anode supporting member is welded to the upper portion 2 and the lower portion 1 of the cathode compartment frame, as shown in FIG. 1.

The transverse width (C8 in FIG. 3) of the cathode supporting member is from 30 to 100 mm, preferably from 50 to 70 mm, and it is preferably the same as the transverse width C5 of the anode supporting member. Further, the longitudinal width B8 (which corresponds to the distance between the cathode plate 60 and the cathode back plate 70) of the cathode supporting member is from 25 to 35 mm, and as mentioned above, it is narrower than the longitudinal width B5 (which corresponds to the spacing between the anode plate 30 and the anode back plate 40) of the anode supporting member.

Figure 1:
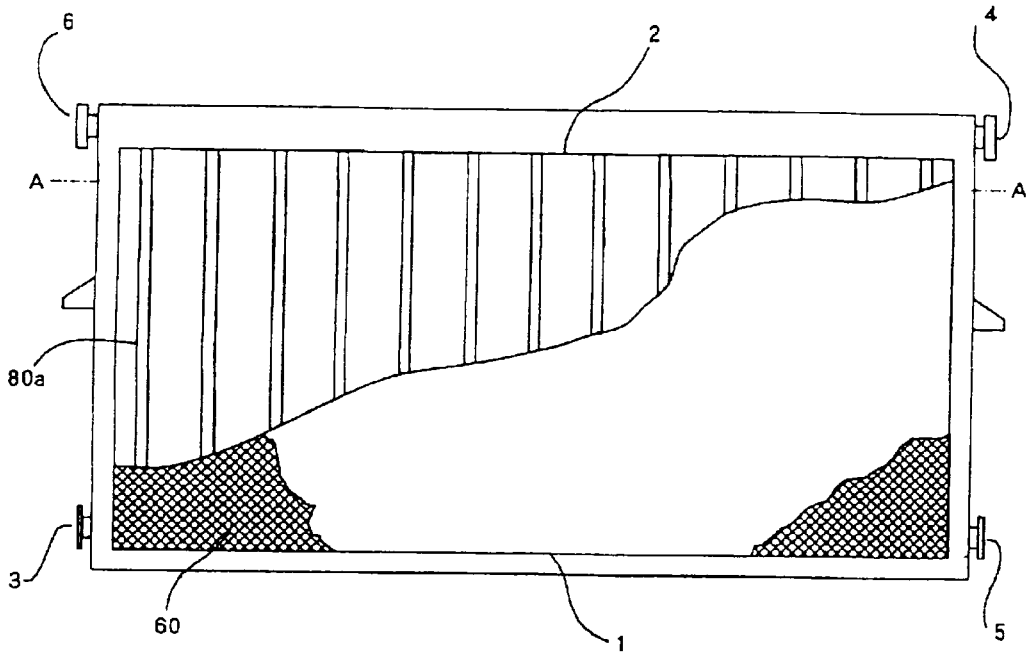
FIG. 1 PRIOR ART
FIG. 1 is a front view of a compartment frame unit of a bipolar cell of the present invention, as observed from a cathode compartment frame.

Further, the distance L8 of adjacent cathode supporting members is from 50 to 200 nm, preferably from 100 to 150 nm, and with this distance, a plurality of cathode supporting members are arranged in parallel with one another to cover the electrolysis area, as shown in FIG. 1.

In the present invention, in the bipolar cell as described above, as shown in FIG. 4, between the adjacent anode supporting members, an anode partition sheet 55 is inserted in substantially parallel with the anode plate to form two spaces 110 and 120 which extend in a vertical direction respectively between the anode partition sheet 55 and the anode plate 30 and between the anode partition sheet 55 and the anode back plate 40, so that the two spaces are connected to each other at their upper and lower portions to form an internal circulation path for an electrolyte.

As the material for the anode partition sheet 55, corrosion resistant titanium or titanium alloy is employed.

The anode partition sheet 55 preferably extends until both ends are in contact with side walls 5*e* of the adjacent anode supporting members, and it is partially fixed to the side walls by e.g. welding.

In order to effectively form the internal circulation path for the electrolyte, the ratio of the distance g1 between the anode partition sheet 55 and the anode plate 30, to the distance g2 between the anode partition sheet 55 and the anode back plate 40, i.e. g1:g2, is-preferably from 1:2 to 1:5, more preferably from 1:3 to 1:4.

Like the anode supporting member, the anode partition sheet 55 extends in a vertical direction from the lower side portion to the upper side portion of the anode compartment, and its upper end and lower end are located at positions distanced from the upper side portion 2 of the compartment frame and the lower side portion 1 of the compartment frame shown in FIG. 1, respectively, by from 10 to 100 mm, preferably from 30 to 60 mm. Namely, the upper end of the anode partition sheet 55 forms an upper opening between it and the upper side portion of the anode compartment frame, and its lower end forms a lower opening between it and the lower side portion of the anode compartment frame. Part of the electrolyte which has ascended together with gas bubbles in the space 110 will flow into the space 120 through the upper opening and then descend in the space 120. Then, the electrolyte passes through the lower opening of the anode partition sheet and will flow into the space 110 again. As mentioned above, the two spaces 110 and 120 are connected to each other by the upper and lower openings to form an internal circulation path for the electrolyte.

Figure 4:
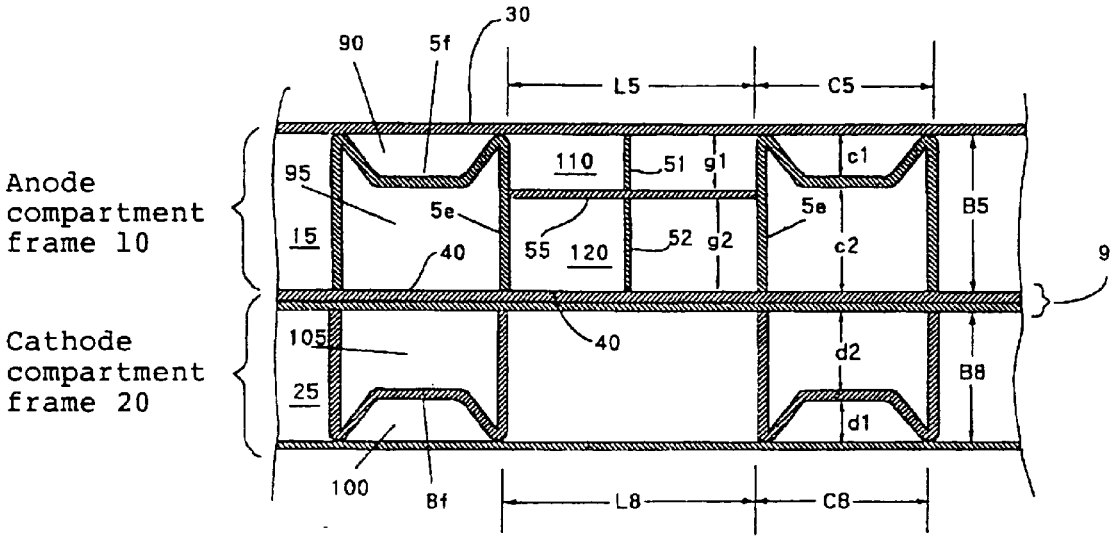
FIG. 4 is a partially cross-sectional view of a bipolar cell of the present invention.

The ratio of the distance g1 between the anode partition sheet 55 and the anode plate 30, to the distance g2 between the anode partition sheet 55 and the anode back plate 40, is set as described above with a view to carrying out the internal circulation effectively. To maintain this ratio during the operation of the electrolytic cell, it is preferred to attach reinforcing members 51 and 52 to the anode partition sheet 55 by welding, screwing or the like, as shown in FIG. 4. In such a case, the other ends of the reinforcing members may be fixed to the anode plate 30 and the anode back plate 40, respectively, by a means such as welding, or they may not be so fixed. These reinforcing members 51 and 52 also have a function to minimize deformation of the anode plate 30 by a pressure from the cathode side during the operation of the electrolytic cell, whereby it is possible to prevent widening of the distance between the anode plate 30 and the cathode plate 60, during the operation.

The reinforcing members 51 and 52 are basically intended to reinforce the mechanical strength of the anode partition sheet, and accordingly, their shapes are not particularly limited. For example, as is evident from FIG. 4, they may be in the form of a plate extending in the up and down direction of the anode compartment frame. In such a case, in order to secure free circulation of the electrolyte in the left and right direction in the same figure i.e. within the spaces 110 and 120, they are preferably ones having a plurality of through-holes or notches formed. Otherwise, they may be a plurality of cylindrical spacers attached back to back on the anode plate side and the anode back plate side of the anode partition sheet 55 in an up and down direction of the compartment frame. Namely, they may be in any shape so long as free circulation of the electrolyte within the spaces 110 and 120 can be secured. The material for the reinforcing members 51 and 52 may be conductive or non-conductive, and corrosion resistant titanium or titanium alloys, or polytetrafluoroethylene (PTFE) may, for example, be used.

Figure 5:
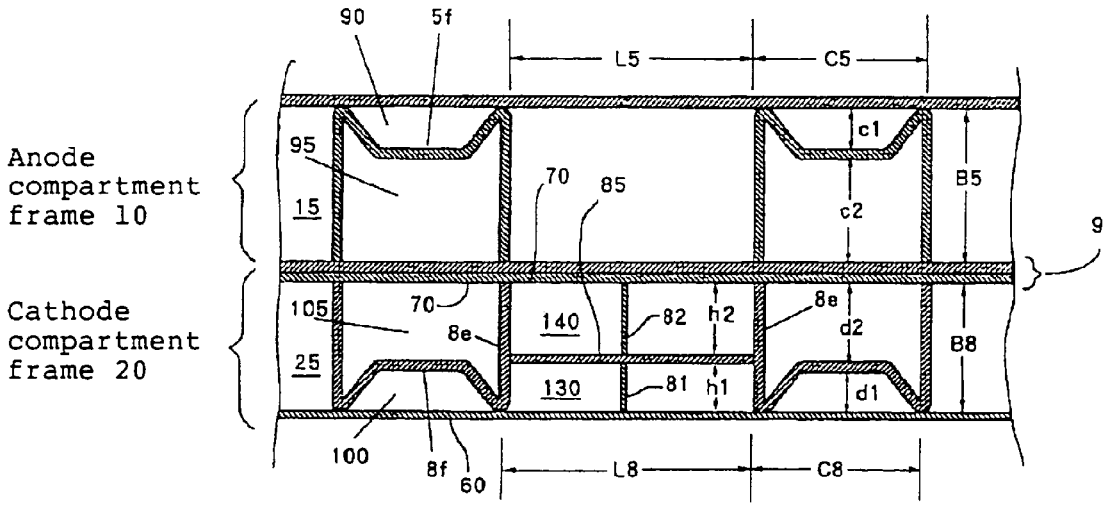
FIG. 5 is a partially cross-sectional view of a bipolar cell of the present invention.

In another embodiment of the present invention, as shown in FIG. 5, between the adjacent cathode supporting members, a cathode partition sheet 85 is inserted in substantially parallel with the cathode plate to form two spaces 130 and 140 which extend in a vertical direction respectively between the cathode partition sheet 85 and the cathode plate 60 and between the cathode partition sheet 85 and the cathode back plate 70, so that the two spaces are connected to each other at their upper and lower portions to form an internal circulation path for an electrolyte.

The material of the cathode partition sheet may, for example, be corrosion resistant nickel or nickel alloys (including stainless steel).

The cathode partition sheet 85 preferably extends until both ends are in contact with the side walls 8*e* of the adjacent cathode supporting members, and they are partially fixed to the side walls by e.g. welding.

In order to effectively form the internal circulation path for the electrolyte, the ratio of the distance h1 between the cathode partition sheet 85 and the cathode plate 60, to the distance h2 between the cathode partition sheet 85 and the cathode back plate 70, i.e. h1:h2, is preferably from 1:2 to 1:5, more preferably from 1:3 to 1:4.

Like the cathode supporting member, the cathode partition sheet 85 extends in a vertical direction from the lower side portion to the upper side portion of the cathode compartment, and its upper end and lower end are located at positions distanced from the upper side portion 2 and the lower side portion 1 of the compartment frame shown in FIG. 1, respectively, by from 10 to 100 mm, preferably from 30 to 60 mm. Namely, the upper end portion of the cathode partition sheet 85 forms an upper opening between it and the upper side portion of the cathode compartment frame, and the lower end portion forms a lower opening between it and the lower side portion of the cathode compartment frame. Part of the electrolyte which has ascended together with gas bubbles in the space 130, will flow into the space 140 through the upper opening, and then descend in the space 140. Then, the electrolyte passes through the lower opening of the cathode partition sheet and will flows into the space 130 again. As described in the foregoing, the two spaces 130 and 140 are connected to each other through the upper and lower openings to form an internal circulation path for the electrolyte.

The ratio of the distance h1 between the cathode partition sheet 85 and the cathode plate 60, to the distance h2 between the cathode partition sheet 85 and the cathode back plate 70, is set as described above, with a view to carrying out the internal circulation effectively. To maintain this ratio during the operation of the electrolytic cell, it is preferred to attach reinforcing members 81 and 82 to the cathode partition sheet 85 by welding, screwing or the like, as shown in FIG. 5. In such a case, the other ends of the reinforcing members may be fixed to the cathode plate 60 and the cathode back plate 70, respectively, by a means such as welding, or may not be so fixed.

The reinforcing members 81 and 82 are basically intended to reinforce the mechanical strength of the cathode partition sheet, and accordingly, their shapes are not particularly limited. For example, as is evident from FIG. 5, they may be in the form of plates extending in an up and down direction of the cathode compartment frame. In such a case, to secure free circulation of the electrolyte in the left and right direction in the figure i.e. within the spaces 130 and 140, they are preferably ones having a plurality of through-holes or notches formed. Otherwise, they may be a plurality of cylindrical spacers attached back to back on the cathode plate side 60 and the cathode back plate side 70 of the cathode partition sheet 85 in an up and down direction of the compartment frame. Namely, they may be in any shape so long as free circulation of the electrolyte within the spaces 130 and 140 can be secured. The material for the reinforcing members 81 and 82 may be conductive or non-conductive, and corrosion resistant nickel or nickel alloys including stainless steel or PTFE may, for example, be employed.

Figure 6:
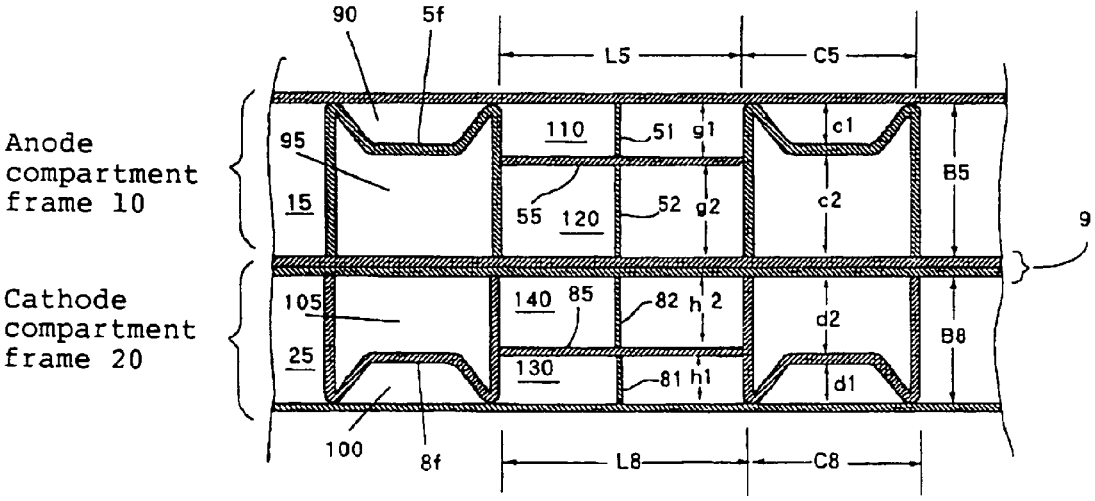
FIG. 6 is a partially cross-sectional view of a bipolar cell of the present invention.

In still another embodiment of the present invention, as shown in FIG. 6, between the adjacent anode supporting members, an anode partition sheet 55 is inserted in substantially parallel with the anode plate to form two spaces 110 and 120, and between the adjacent cathode supporting members, a cathode partition sheet 85 is inserted in substantially parallel with the cathode plate to form two spaces 130 and 140, so that the respective pairs of spaces are connected to each other at their upper and lower portions to form internal circulation paths, whereby internal circulation of the anolyte and the catholyte is substantially increased to make it possible to reduce the cell voltage.

In the present invention, the anode supporting member or the cathode supporting member is not limited to one having a generally M-shape.

Figure 7:
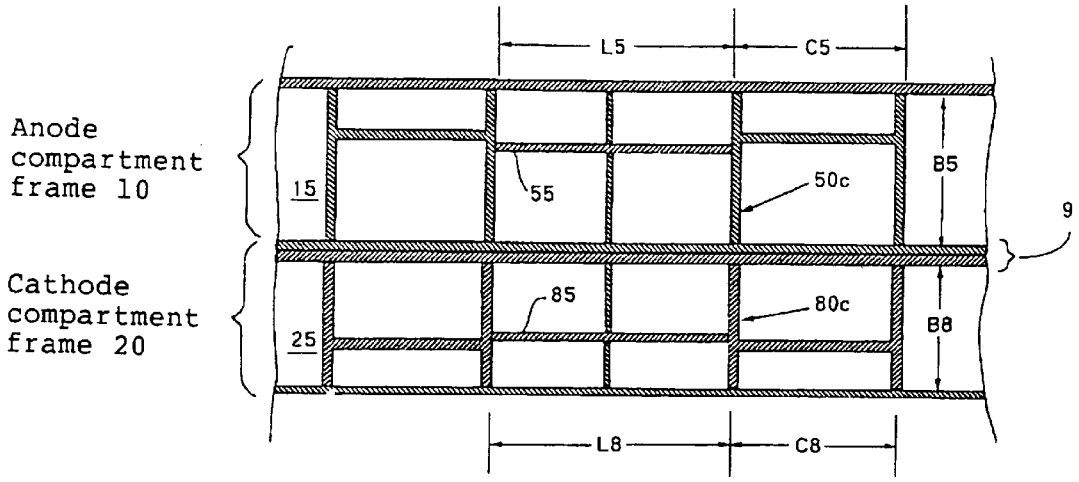
FIG. 7 is a partially cross-sectional view of a bipolar cell of the present invention.
Figure 8:
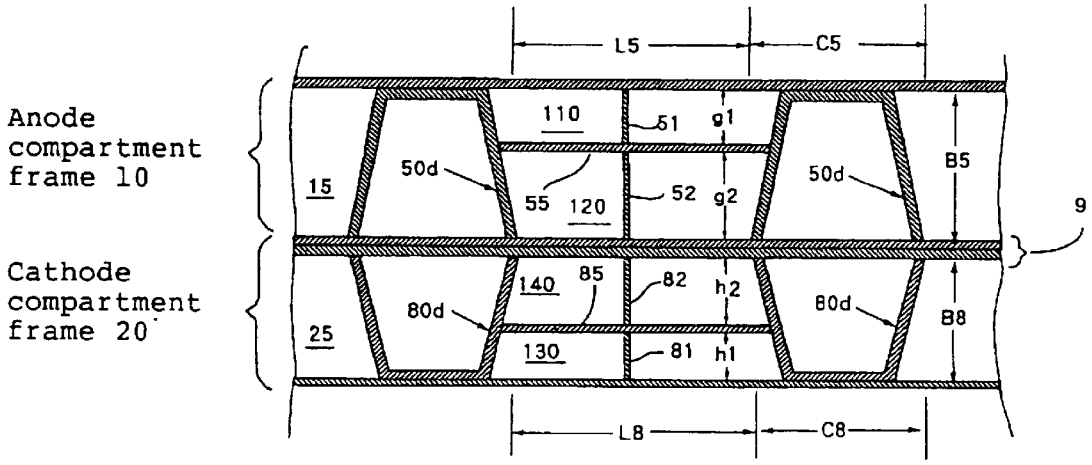
FIG. 8 is a partially cross-sectional view of a bipolar cell of the present invention.

For example, FIG. 7 shows an embodiment wherein an anode supporting member 50*c* and a cathode supporting member 80*c* each having a generally H-shape in cross section, are used, and FIG. 8 shows an embodiment wherein an anode supporting member 50*d* and a cathode supporting member 80*d* each having a generally trapezoid in cross section, are used. In each embodiment, as in FIG. 6, between the adjacent anode supporting members, an anode partition sheet 55 is inserted in substantially parallel with the anode plate to form two spaces, and between the adjacent cathode supporting members, a cathode partition sheet 85 is inserted in substantially parallel with the cathode plate to form two spaces, so that the respective pairs of spaces are connected to each other at their upper and lower portions to form internal circulation paths.

By adopting the structure as described above, the present invention makes it possible to substantially increase internal circulation of the electrolyte and to maintain the distribution of the electrolyte concentration to be uniform even at a high current density thereby to make it possible to reduce the cell voltage.

Now, the present invention will be described in further detail with reference to Examples. However, it should be understood that the present invention is by no means restricted to such specific Examples.

EXAMPLE 1

Electrolysis of sodium chloride was carried out by using the bipolar cell provided with anode partition sheets, of the present invention, whereby the distribution of the NaCl concentration in the anode compartment was measured. The dimensions of the electrode plate in each compartment frame were 2,400 mm in width and 1,200 mm in height. For the anode plate, an expanded mesh type DSE manufactured by Permelek Electrode Co., Ltd. having a Ti plate thickness of 1.7 mm was used, and for the cathode plate, a nickel expanded mesh having a plate thickness of 1.2 mm was used as the substrate. The cathode substrates were coated with activated Raney nickel. As the anode back plate, a titanium plate having a thickness of 1.2 mm was used, and as the cathode back plate, a nickel plate having a thickness of 1.2 mm was used.

For the anode supporting members (anode ribs), those made of titanium and formed to have a M-shape in cross section, as shown in FIGS. 3 and 4, were used. With C5=60 mm, B5=35 mm, c1 (the distance between 5*f* and the anode plate 30)=10 mm, A5=1.5 mm and L5=140 mm, twelve anode supporting members were arranged in the same manner as the cathode supporting members shown in FIG. 1 and fixed to the anode plate and the anode back plate by welding.

For the cathode supporting members (cathode ribs), those made of nickel and having a M-shape in cross section, as shown in FIGS. 3 and 4, were used. With C8=60 mm, B8=30 mm, d1 (the distance between 8*f* and the cathode plate 60)=10 mm, A8=1.5 mm and L8=140 mm, twelve cathode supporting members were arranged as shown in FIG. 1 and fixed to the cathode plate and the cathode back plate by welding. Namely, B5–B8=5 mm.

As a anode partition sheet, a titanium plate having a thickness of 0.8 mm was inserted, as shown in FIG. 4, between the adjacent anode supporting members, at a position of 9 mm from the anode plate (g1=9 mm) and fixed to the anode supporting members by welding. This anode partition sheet was further fixed by welding to reinforcing members (51, 52) made of titanium plates of 0.8 mm with their end edges welded to the anode plate and the anode back plate. The number of anode partition sheets installed was 11 sheets. The distance (g2) of each anode partition sheet from the anode back plate was 25.2 mm (g1+g2=34.2 mm).

Four compartment frame units each comprising such an anode compartment frame and a cathode compartment frame, and ion exchange membranes, were alternately arranged by interposing gaskets and clamped from both sides by a clamping means made of iron to form a bipolar cell. As cation exchange membranes, Fremion membranes F-893 (tradename, manufactured by Asahi Glass Co., Ltd.) were used.

Into the anode compartments, an aqueous sodium chloride solution of 300 g/lit. was supplied from an inlet for the anolyte at a lower portion of the compartment frames, so that the NaCl concentration at the outlet became about 210 g/l and into the cathode compartments, a dilute sodium hydroxide aqueous solution was supplied from an inlet for a catholyte at a lower portion of the compartment frames, so that the concentration of the sodium hydroxide aqueous solution at the outlet became 32 wt %.

Electrolysis tests were carried out under the current density within a range of from 1 to 6 kA/m$^2$. With respect to the NaCl concentrations within the anode compartment frames, at three points of the upper end portion, the center portion and the lower end portion on a few anode supporting members and at three points at a few locations between the anode supporting members, the electrolytes at such portions were directly sampled and subjected to the concentration analysis, and the NaCl concentration difference (g/l) or the sodium hydroxide concentration difference (%), between the highest concentration portion and the lowest concentration portion, was obtained. The results are shown in Table 1.

TABLE 1

| Current density (kA/m$^2$) | Temperature for electrolysis (° C.) | NaCl concentration difference (g/l) On the anode supporting members | Between the anode supporting members |
|---|---|---|---|
| 1 | 70 | 2 | 2 |
| 2 | 78 | 2 | 3 |
| 4 | 85 | 5 | 6 |
| 5 | 88 | 6 | 7 |
| 6 | 90 | 5 | 7 |

As is evident from Table 1, even at a high current density of 6 kA/m$^2$, it is possible to control the distribution of the NaCl concentration to a level of not higher than 10 g/l. Further, the cell voltage per unit at 6 kA/m$^2$ was 3.37 V.

EXAMPLE 2

Electrolysis was carried out in the same manner as in example 1 except that as the anode partition sheet, a titanium plate having a thickness of 0.8 mm was inserted between the adjacent anode supporting members, as shown in FIG. 4, at a position of 6 mm from the anode plate (g1=6 mm) (the distance (g2) from the anode back plate was 28.2 mm), and the NaCl concentration was measured. The results are shown in Table 2. Further, the cell voltage per unit at a current density of 6 kA/m$^2$, was 3.38 V.

TABLE 2

| Current density (kA/m$^2$) | Temperature for electrolysis (° C.) | NaCl concentration difference (g/l) On the anode supporting members | Between the anode supporting members |
|---|---|---|---|
| 1 | 70 | 2 | 2 |
| 2 | 78 | 3 | 3 |
| 4 | 85 | 6 | 4 |
| 5 | 88 | 9 | 6 |
| 6 | 90 | 10 | 6 |

EXAMPLE 3

Electrolysis was carried out in the same manner as in example 1 except that as the anode partition sheet, titanium plates having a thickness of 0.8 mm was inserted between the adjacent anode supporting members, as shown in FIG. 4, at a position of 12 mm from the anode plate (g1=12 mm) (the distance (g2) from the anode back plate was 22.2 mm), and the NaCl concentration was measured. The results are shown in Table 3. Further, the cell voltage per unit at a current density of 6 kA/m$^2$ was 3.38 V.

TABLE 3

| Current density (kA/m$^2$) | Temperature for electrolysis (° C.) | NaCl concentration difference (g/l) On the anode supporting members | Between the anode supporting members |
|---|---|---|---|
| 1 | 70 | 2 | 3 |
| 2 | 78 | 3 | 4 |
| 4 | 85 | 5 | 7 |
| 5 | 88 | 5 | 10 |
| 6 | 90 | 7 | 10 |

EXAMPLE 4

Electrolysis was carried out in the same manner as in example 1 except that as the cathode partition sheet, a nickel plate having a thickness of 0.8 mm was inserted between the adjacent cathode supporting members, as shown in FIG. 6, at a position of 9 mm from the cathode plate (h1=9 mm) (the distance (h2) from the cathode back plate was 20.2 mm), and the sodium hydroxide concentration was measured. The results are shown in Table 4. Further, the cell voltage per unit at a current density of 6 kA/m$^2$ was 3.33 V.

TABLE 4

| Current density (kA/m$^2$) | Temperature for electrolysis (° C.) | Sodium hydroxide concentration difference (%) On the cathode supporting members | Between the cathode supporting members |
|---|---|---|---|
| 1 | 70 | 0.11 | 0.10 |
| 2 | 78 | 0.10 | 0.13 |
| 4 | 85 | 0.13 | 0.17 |
| 5 | 88 | 0.13 | 0.18 |
| 6 | 90 | 0.13 | 0.21 |

COMPARATIVE EXAMPLE 1

The same experiment as in Example 1 was carried out except that in Example 1, no partition sheet was used as in FIG. 3, and the NaCl concentration was measured. The results are shown in Table 5. Further, the cell voltage per unit at a current density of 6 kA/m$^2$ was 3.40 V.

TABLE 5

| Current density (kA/m$^2$) | Temperature for electrolysis (° C.) | NaCl concentration difference (g/l) On the anode supporting members | Between the anode supporting members |
|---|---|---|---|
| 1 | 70 | 3 | 3 |
| 2 | 78 | 6 | 8 |
| 4 | 85 | 11 | 16 |
| 5 | 88 | 16 | 21 |
| 6 | 90 | 19 | 27 |

What is claimed is:

1. A bipolar ion exchange membrane electrolytic cell comprising:

an anode compartment frame which comprises an anode plate and an anode back plate arranged in substantially parallel with each other with a spacing, and a conductive anode supporting member arranged between the anode plate and the anode back plate; and a cathode compartment frame which comprises a cathode plate and a cathode back plate arranged in substantially parallel with each other with a spacing, and a conductive cathode supporting member arranged between the cathode plate and the cathode back plate, wherein the anode back plate and the cathode back plate are connected back to back to form a partition wall for a bipolar electrolytic cell, the spacing between the anode plate and the anode back plate is wider than the spacing between the cathode plate and the cathode back plate, at least one of said anode compartment frame and said cathode compartment frame has a plurality of said anode supporting member and said cathode supporting member respectively, when said anode compartment frame has a plurality of said anode supporting member, between adjacent anode supporting members, an anode partition sheet is inserted in substantially parallel with the anode plate to form two first spaces which extend in a vertical direction respectively between the anode partition sheet and the anode plate, and between the anode partition sheet and the anode back plate, so that the two first spaces are connected to each other at their upper and lower portions to form an internal circulation path for an electrolyte, and when said cathode compartment frame has a plurality of said cathode supporting member, between adjacent cathode supporting members, a cathode partition sheet is inserted in substantially parallel with the cathode plate to form two second spaces which extend in a vertical direction respectively between the cathode partition sheet and the cathode plate and between the cathode partition sheet and the cathode back plate, so that the two second spaces are connected to each other at their upper and lower portions to form an internal circulation path for an electrolyte.

2. The bipolar ion exchange membrane electrolytic cell according to claim 1, wherein each anode supporting member has a generally M shape in its cross section to form the anode partition sheet and the two first spaces which extend in a vertical direction respectively between the anode partition sheet and the anode plate, and between the anode partition sheet and the anode back plate, so that the two fis spaces are connected to each other at their upper and lower portions to form the internal circulation path for an electrolyte, each cathode supporting member has a generally M shape in its cross section to form the cathode partition sheet and the two second spaces which extend in a vertical direction respectively between the cathode partition sheet and the cathode plate, and between the cathode partition sheet and the cathode back plate, so that the two spaces are connected to each other at their upper and lower portions to form the internal circulation path for an electrolyte.

3. A method for electrolyzing an aqueous alkali metal chloride solution to produce chlorine and an alkali metal hydroxide, comprising:

supplying an anolyte to an anode compartment frame which comprises an anode plate and an anode back plate arranged substantially in parallel with each other and separated by a spacing, and a conductive anode supporting member arranged between the anode plate and the anode back plate; and supplying a catholyte to a cathode compartment frame which comprises a cathode plate and a cathode back plate arranged substantially in parallel with each other and separated by a spacing, and a conductive cathode supporting member arranged between the cathode plate and the cathode back plate, wherein the anode back plate and the cathode back plate are connected back to back to form a partition wall for a bipolar electrolytic cell, the spacing between the anode plate and the anode back plate is wider than the spacing between the cathode plate and the cathode back plate, at least one of said anode compartment frame and said cathode compartment frame has a plurality of said anode supporting member and said cathode supporting member respectively, when said anode compartment frame has a plurality of said anode supporting member, between adjacent anode supporting members, an anode partition sheet is inserted in substantially parallel with the anode plate to form two first spaces which extend in a vertical direction respectively between the anode partition sheet and the anode plate, and between the anode partition sheet and the anode back plate, so that the two first spaces are connected to each other at their upper and lower portions to form an internal circulation path for an electrolyte, and when said cathode compartment frame has a plurality of cathode supporting members, between adjacent cathode supporting members, a cathode partition sheet is inserted in substantially parallel with the cathode plate to form two second spaces which extend in a vertical direction respectively between the cathode partition sheet and the cathode plate and between the cathode partition sheet and the cathode back plate, so that the two second spaces are connected to each other at their upper and lower portions to form an internal circulation path for an electrolyte.

4. The method for electrolyzing an aqueous alkali metal chloride solution according to claim 3, comprising:

performing said supplying steps at an electrolytic current density of from 1 to 8 $kA/m^2$.

* * * * *

UNITED STATES PATENT AND TRADEMARK OFFICE

CERTIFICATE OF CORRECTION

PATENT NO. : 6,063,257

DATED : May 16, 2000

INVENTOR(S): Tatsuhito KIMURA, et al.

It is certified that an error appears in the above-identified patent and that said Letters Patent is hereby corrected as shown below:

On the title page, item [30], the Foreign Application Priority Data is incorrectly listed. It should read as follows:

--[30] Foreign Application Priority Data

Sep. 30, 1997 [JP] Japan .....9-281089--

Signed and Sealed this

Tenth Day of April, 2001

*Attest:*

Nicholas P. Godici

NICHOLAS P. GODICI

*Attesting Officer*

*Acting Director of the United States Patent and Trademark Office*